US006915107B1

(12) United States Patent
Lusk

(10) Patent No.: US 6,915,107 B1
(45) Date of Patent: Jul. 5, 2005

(54) REVENUE GENERATING METHOD OF BROADCASTING ON FM SUBCARRIER

(75) Inventor: Dennis W. Lusk, Odessa, FL (US)

(73) Assignee: Florida Digital Technologies, Inc., Odessa, FL (US)

( * ) Notice: Subject to any disclaimer, the term of this patent is extended or adjusted under 35 U.S.C. 154(b) by 505 days.

(21) Appl. No.: 10/064,274

(22) Filed: Jun. 27, 2002

Related U.S. Application Data

(60) Provisional application No. 60/319,154, filed on Mar. 25, 2002.

(51) Int. Cl.[7] ..... H04H 7/00

(52) U.S. Cl. ..... 455/3.06; 455/45; 455/66.1

(58) Field of Search ..... 455/3.06, 3.04, 455/3.03, 456.1–6, 414.1–4, 66.1, 227, 228, 230

(56) References Cited

U.S. PATENT DOCUMENTS

| | | | | |
|---|---|---|---|---|
| 5,023,933 A | | 6/1991 | Karkota, Jr. | |
| 5,164,904 A | | 11/1992 | Sumner | |
| 5,193,213 A | | 3/1993 | Chon | |
| 5,404,566 A | * | 4/1995 | Wehrmeyer | 455/3.06 |
| 5,661,787 A | * | 8/1997 | Pocock | 455/45 |
| 5,815,802 A | | 9/1998 | Loechner, II | |
| 5,850,190 A | | 12/1998 | Wicks et al. | |
| 6,014,090 A | | 1/2000 | Rosen et al. | |
| 6,064,318 A | | 5/2000 | Kirchner, III et al. | |
| 6,081,200 A | | 6/2000 | Park | |
| 6,091,956 A | | 7/2000 | Hollenberg | |
| 6,232,888 B1 | | 5/2001 | Davis et al. | |
| 6,255,963 B1 | | 7/2001 | Heimann et al. | |
| 6,330,334 B1 | | 12/2001 | Ryan | |
| 6,335,693 B1 | | 1/2002 | Takahashi et al. | |
| 6,349,262 B1 | | 2/2002 | Lewiner et al. | |
| 2001/0014849 A1 | | 8/2001 | King et al. | |
| 2002/0032035 A1 | * | 3/2002 | Teshima | 455/456 |

OTHER PUBLICATIONS

ComPol, Inc., ComPol Technology, http://www.compolinc-.com/compol_technology.htm, Jul. 12, 2002.

* cited by examiner

*Primary Examiner*—Nay Maung
*Assistant Examiner*—Philip J. Sobutka
(74) *Attorney, Agent, or Firm*—Anton J. Hopen; Smith & Hopen, P.A.; Molly L. Sauter

(57) ABSTRACT

A method of generating advertising revenue by securing an FM subcarrier frequency through an FM broadcasting station and distributing portable receivers to end users tailored to play the audio signals broadcast over the FM subcarrier frequency, on demand. Public service audio clips and advertising audio clips are broadcast to the portable receivers with the intention that a listener will be exposed to both the public service audio clip and the advertising audio clip during the period of the broadcast. The public service audio clips and advertising audio clips are broadcast in a continuous loop and are coded with start and stop signals to indicate the beginning and end of the broadcast. Through this method, an individual requesting the broadcast will hear a signal loop of the audio, starting with the detection of the start signal and ending when the detection of the stop signal.

53 Claims, 8 Drawing Sheets

REVENUE GENERATING METHOD OF BROADCASTING ON FM SUBCARRIER

CROSS REFERENCE TO RELATED APPLICATIONS

This application claims the benefit of U.S. Provisional Application Ser. No. 60/319,154, filed Mar. 25, 2002, and incorporated herein by reference.

BACKGROUND OF INVENTION

1. Field of Invention

This application relates, generally, to a method of providing information over an FM subcarrier frequency, and specifically to a revenue producing model of providing instant reporting of content specific information to commuters.

2. Background of Invention

When the FCC established the FM broadcast system, they assigned each station a channel with a width of 200 kHz. As an example, the station assigned to 88.1 Mhz (88,100 kHz) is authorized to use frequencies from 88,000 kHz to 88,200 kHz. When a tone of a certain frequency is transmitted over FM, the bandwidth of the transmitted signal is a minimum of twice that frequency. As such, frequencies of up to 100 kHz can be transmitted on an FM broadcast station. The average person can only hear frequencies up to 15 kHz, leaving an abundance of space on the FM transmitter for other signals.

To provide extra channels that could be sold by the FM stations in an effort to increase their revenue and offset their investment in equipment, the FCC created SCA. SCA stands for Subsidiary Communications Authorization. In the late '40s and early '50s, the FM band was not a major profit center for the broadcasters that had invested heavily in transmission equipment, and they asked the FCC for additional ways to leverage their investment. Some FM broadcasters played easy listening music and preceded all commercial breaks with a sub-audible tone. They then "sold" the signal to stores, with receivers that would mute the commercials when the tone was detected. The FCC outlawed this practice, saying that although it would be legal to build a radio that could detect commercials and dump them, it would not be legal for broadcasters to generate any kind of special signal on the air to identify commercials. But, this practice helped create a market for commercial background music. Originally, the commission specified very precisely the SCA frequencies and bandwidth that could be used and sold. Now, broadcasters are allowed to place any kind of signal, digital or analog, at any frequency or bandwidth, as long as it does not interfere with the main channel signal or extend the bandwidth of the FM station much beyond the 100 kHz allocation.

The frequencies from 19 kHz to 53 kHz are used for transmission of stereo. Thus, the frequencies from 53 kHz to 100 kHz are not usable for the transmission of SCA programming. SCA utilizes the frequency bands that center on 67 kHz and 92 kHz through the use of frequency modulation. These frequencies are well beyond human hearing range, and therefore have no effect on the reception of normal programming. A typical SCA channel is an FM carrier wave, basically a high-pitched whistle at 67 kHz or 92 kHz. At the SCA receiver, the subcarrier signal is demodulated and the information is heard by the user over the receiver speaker.

Transmission of an encoded signal with information separate from that of the material of the main signal has proven to be possible and realistic. In the 70's, many voice and data signals began to appear on SCAs. Agri-ports used voice channels and later data transmission to bring commodity prices to their network of grain elevators, brokers, etc. The Bonneville Corporation created a high-speed data service with commodity prices and many SCA broadcasts provided new and music in Chinese, Greek, Korean and various other languages.

During the 70's, the Physicians' Radio Network, transmitted news, short educational courses, live call-in shows, and reports from various medical associations to physicians and was available nationwide on SCA. The broadcast from the Physicians' Radio Network also included advertisements related to pharmaceutical products. Pharmaceutical Representatives distributed portable SCA receivers to physicians. As such, the Physicians' Radio Network (PRN) was a for-profit enterprise, financed by drug company advertising.

Traffic reports are provided by the radio and television media and are used by commuters to plan their routes. It is desirable to know the condition of the roads, potential congestion and accidents in advance of leaving for a destination. Existing reporting systems on the various media are inadequate to provide drivers with the information they need to plan their commute. Most commonly, drivers receive traffic congestion information over the radio. Traffic reports communicated via the radio have several disadvantages: the traffic report is not updated frequently, and therefore, inaccurate information is provided to the driver; the broadcast of the traffic report is not necessarily announced at the time the driver needs the information; due to their infrequency, traffic reports are easily missed or the driver may tune in while the report is in progress and pertinent information; and, the driver must interrupt other listening devices in the vehicle, such as CD players and tapedecks, to locate the traffic report on their car radio.

The ARI service utilizes a 57 kHz subcarrier frequency to broadcast voice messages regarding hazardous weather or traffic conditions. The voice message sent by this service is a continuous transmission. Tuning into a continuous transmission often results in missed information. The information is not available on-demand as controlled by the user. The ARI service has not been aggressively promoted by radio stations because it lacks the opportunity for revenue generation.

SCA receivers adapted to receive and demodulate FM subcarrier frequency broadcasts are well known in the art. U.S. Pat. No. 5,023,933, entitled "Superheterodyne SCA Receiver and Method for the Manufacture Thereof", U.S. Pat. No. 5,193,213, entitled "FM Broadcast Band Subcarrier Receiver", and several others provide various solutions to some of the problems associated with SCA receivers. Solutions have been provided to improve passband characteristics, reduce noise and distortion, and improve portable reception. ComPol, Inc. is a technology leader in SCA reception providing products for both the commercial and consumer market. ComPol, Inc. markets a 7×2.5×0.75 inch, battery operated, portable SCA receiver with a belt-clip.

U.S. Pat. No. 4,480,253, entitled "Portable Traffic Congestion Radio", describes a method for presenting traffic condition information to a user by use of a portable, battery operated receiving and data processing device. However, this patent requires the use of digitally coded traffic reports and does not utilize the SCA frequencies for transmission of information.

While FM subcarrier receivers are well known in the art and various services are available that provide information utilizing the SCA frequencies, the combination of the known receivers and services does not provide a cost effective solution to an individuals need for instant, on-demand, content specific information. More specifically, the prior art solutions for supplying traffic information do not describe a method by which continuously updated traffic information is provided to drivers, on demand. Prior art solutions do not describe the importance of revenue generation to the adoption continued growth on an instant reporting system.

There remains a need, therefore, for a cost effective solution to provide continuous traffic information to drivers on an as-needed basis.

However, in view of the prior art considered as a whole at the time the present invention was made, it was not obvious to those of ordinary skill in the pertinent art how the identified need could be fulfilled.

SUMMARY OF INVENTION

The longstanding but heretofore unfulfilled need for a method that provides commuters with updated, on demand, traffic information is now met by a new, useful, and non-obvious invention.

A method of providing content specific information over an FM subcarrier frequency, on demand, is described. An FM subcarrier frequency is used to broadcast information to portable receivers tailored to play the audio signals at the request of the listener. A public service audio clip is created from content specific information. Additionally, advertising audio clips are created. An automated playback recording of the public service audio clip and the advertising audio clip is produced. The automated playback recording is modulated and transmitted over the FM subcarrier frequency in a continuous loop together with a start signal identifying the beginning of the broadcast and a stop signal identifying the end of the broadcast. On demand from a listener, the automated playback recording is played over the portable receiver speaker such that the broadcast begins with the start signal and ends with the stop signal.

According to another aspect of the invention, the FM subcarrier is leased from an FM broadcasting station operating between about 88 Mhz and about 108 Mhz.

The content specific information to be supplied to the listeners is compiled by the lessee or by the broadcasting station. The content specific information may include traffic congestion information, current stock reports, current sports scores, emergency public safety information or any of a variety of other subject matter. The content specific information is continuously updated with the latest information available.

The portable receiver FM subcarrier of the present invention may be purchased by an end user or may be purchased by the advertising sponsors and distributed to end user. The portable receiver is battery operated and serves the primary task of demodulating the FM subcarrier transmission. The end user initiates power to the receiver and controls the speaker volume. Initiation by the user may be through mechanical means, voice activation, movement sensitivity, timing, or one of a variety of other power initiation schemes. Upon receipt of the start signal, the receiver demodulates the transmission and plays the audio over the receiver speaker until the stop signal is received.

In another aspect of the invention, the utilization of the FM subcarrier receivers is measured using at least one strategically located spectrum analyzer to identify the subcarrier frequency when the receiver is receiving and demodulating the signal. The results of the spectrum analyzer are collected and used to establish a utilization measurement to assist sponsors in determining their advertising effectiveness.

According to another embodiment of the invention, a method of providing content specific information over an FM subcarrier frequency, on demand, is described. An FM subcarrier frequency is used to broadcast information to portable receivers tailored to play the audio signals at the request of the listener. A public service audio clip is created from content specific information. Additionally, advertising audio clips are created. An automated playback recording of the public service audio clip and the advertising audio clip is produced. The automated playback recording is modulated and transmitted over the FM subcarrier frequency in a continuous loop together with a start signal identifying the beginning of the broadcast, a stop signal identifying the end of the broadcast, and an inaudible verification tone. The verification may be broadcast over an additional FM subcarrier frequency. On demand from a listener, upon receipt of the verification tone, the automated playback recording is played over the portable receiver speaker such that the broadcast begins with the start signal and ends with the stop signal. In the absence of the verification tone, the speaker volume is muted, thus preventing unauthorized use of the receiver for the reception of other subfrequency signals.

In another aspect of the invention, geographic territories are established and assigned a specific subcarrier frequency. By tailoring the portable receiver to receive the specific subcarrier frequency, listeners are demographically targeted and exposed to a specific advertising audio clip based on the geographic territory. Additionally, public service audio categories are established and assigned a specific FM subcarrier frequency, thereby allowing targeting of the advertising audio clip to specific audio categories.

In yet another aspect of the invention, reward-based audio clips are used to produce a measureable user response. The broadcast of the reward-based audio clip will create a user response that can be measured and evaluated to determine the exposure of listeners to the advertising audio clips. Through this method, advertisers are provided with empirical data to support their advertising expenditure and listeners are encouraged to listen more frequently. In an alternative embodiment of the invention, end users pay a subscription fee to access the broadcasts. The fee may be paid in one payment or staggered at intervals.

A specific objective of the present invention is to provide a method by which revenue is generated through the sale of FM subcarrier receivers and sponsor advertising. The generated revenue will create a viable business opportunity and supplement the expansion of the instant reporting system into additional markets.

An additional objective is to provide a dedicated, portable, FM subcarrier receiver adapted to receive content specific information modulated with start and stop tones, allowing the user to request traffic information on-demand. As such, the user will not be subjected to misinformation and the user will be insured of receiving a current, complete, traffic report when requested.

Still another objective is to provide an FM subcarrier receiver adapted to receive only the broadcast for which the receiver was intended, preventing the use of the device for reception of proprietary broadcasts from other subcarrier frequencies.

Another objective is to provide the user with a traffic reporting solution that does not interrupt other vehicle listening devices, such as CD players and tapedecks.

Still another objective is to provide sponsors with results of the effectiveness of their marketing expenditures through the use of spectrum analyzers to detect when and where the subcarrier receivers are being utilized.

The invention accordingly comprises the features of construction, combination of elements, and arrangement of parts that will be exemplified in the description set forth hereinafter and the scope of the invention will be indicated in the claims.

Other aspects and advantages of the present invention can be seen upon review of the figures, the detailed description, and the claims which follow.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
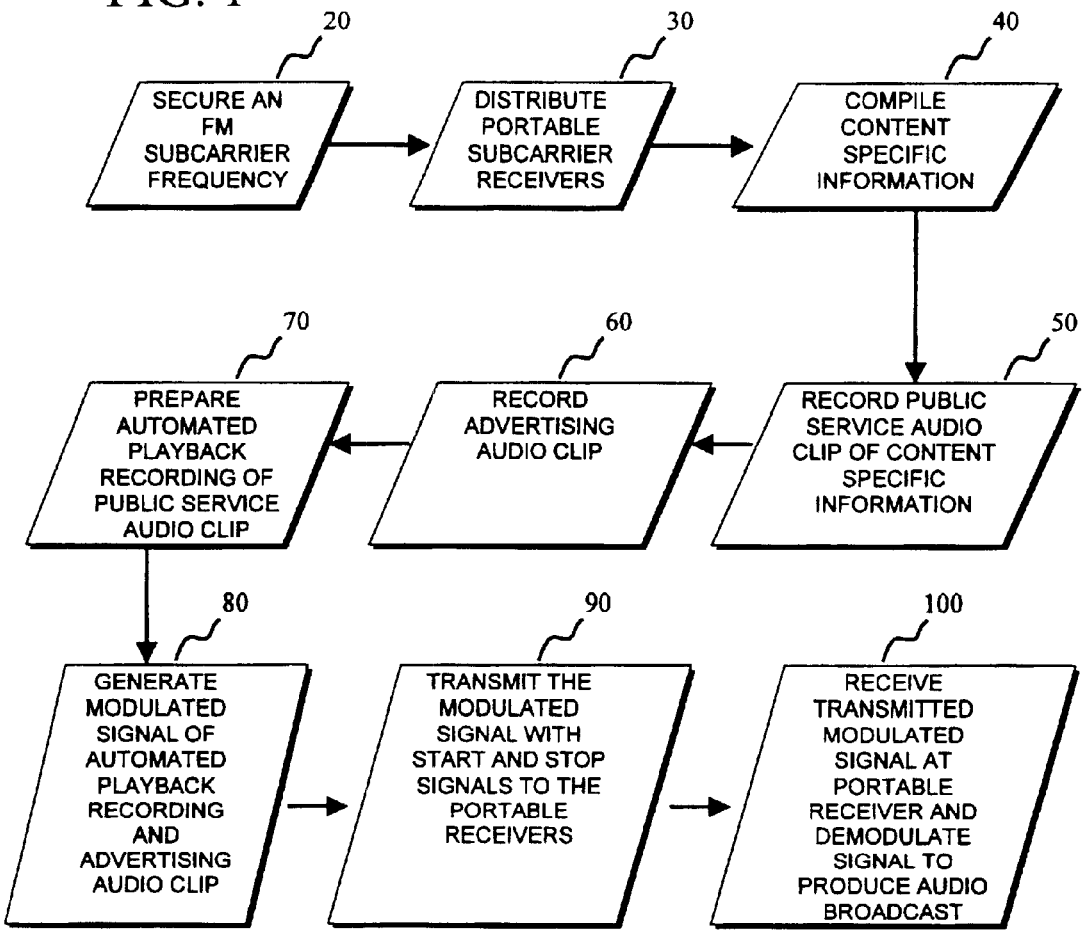
FIG. 1 is a flow diagram of Revenue Generating Method of Broadcasting on FM Subcarrier as described.

Referring initially to FIG.1, a method of providing content specific information over an FM subcarrier frequency, at the request of a user, is described. An FM subcarrier frequency is used for signal transmission 20. The FM subcarrier can be leased from an FM broadcasting station. Portable FM subcarrier receivers are distributed 30. Distribution of the portable receivers can occur through the sale of receivers to end users, promotional distribution by the radio station, purchase and subsequent distribution by the advertising sponsors, or a variety of other methods of distribution. Content specific information is compiled 40. The content specific information may consist of traffic congestion reports, the latest sports scores, the latest stock reports, weather reports, public emergency broadcasts, or a variety of other types of information. The content specific information may be compiled by the leesee of the FM subcarrier frequency, or through a contract with the FM broadcasting station. The content specific information is constantly updated with the most current information available and a public service audio clip of the content specific information is recorded for broadcast 50. Advertising contracts are established with sponsors and advertising audio clips are recorded 60. An automated playback recording of the public service audio clip is prepared 70. A modulated signal of the automated playback recording and the advertising audio clip is generated 80. The modulated signal is transmitted, along with start and stop signals, to portable receivers 90. The portable receiver receives the transmitted, modulated signal and demodulates the signal to produce the audio broadcast for listener 100. The start and stop signals indicate the duration of the broadcast. The start signal is placed at the beginning of the transmission. The stop signal is placed at the end of the transmission. When a listener requests to hear the broadcast, the receiver plays the broadcast beginning when the start signal is received and ending when the stop signal is received. This method insures that the listener will hear the entire broadcast, from beginning to end. The automated playback and the advertising audio clip are transmitted in a continuous loop. The automated playback is updated with current information as necessary and the advertising audio clip is adjusted according to the advertising contract. The stop signal can also be used to turn power off to the receiver as required.

Figure 2:
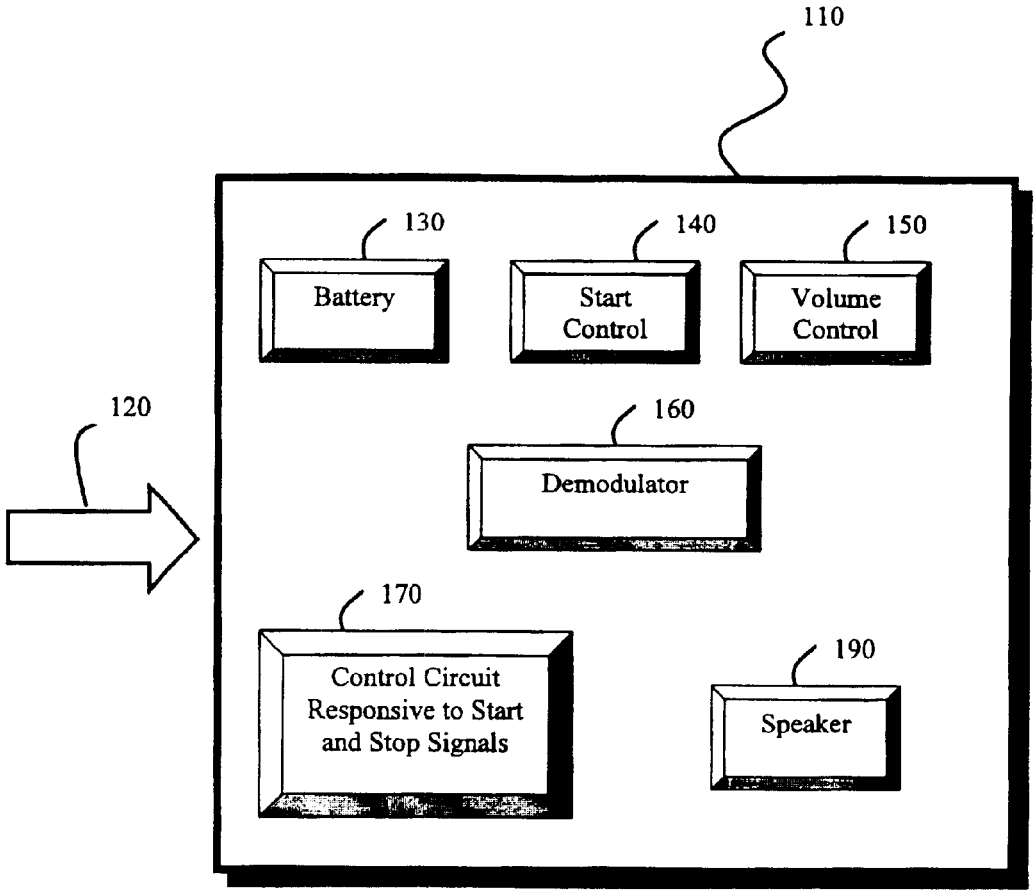
FIG. 2 is a block diagram of the portable receiver as described.

FIG. 2 illustrates the basic components of the portable receiver. Battery 130 powers the portable receiver, although other methods of supplying power are within the scope of this invention. Start control 140 initiates power to the receiver. Demodulator 160 demodulates received signal 120. Control circuit 170 monitors the receipt of the start and stop signals, allowing a single loop of the audio to play upon receipt of the start signal and until the stop signal is detected. And, volume control 150 is provided for controlling the speaker volume.

Figure 3:
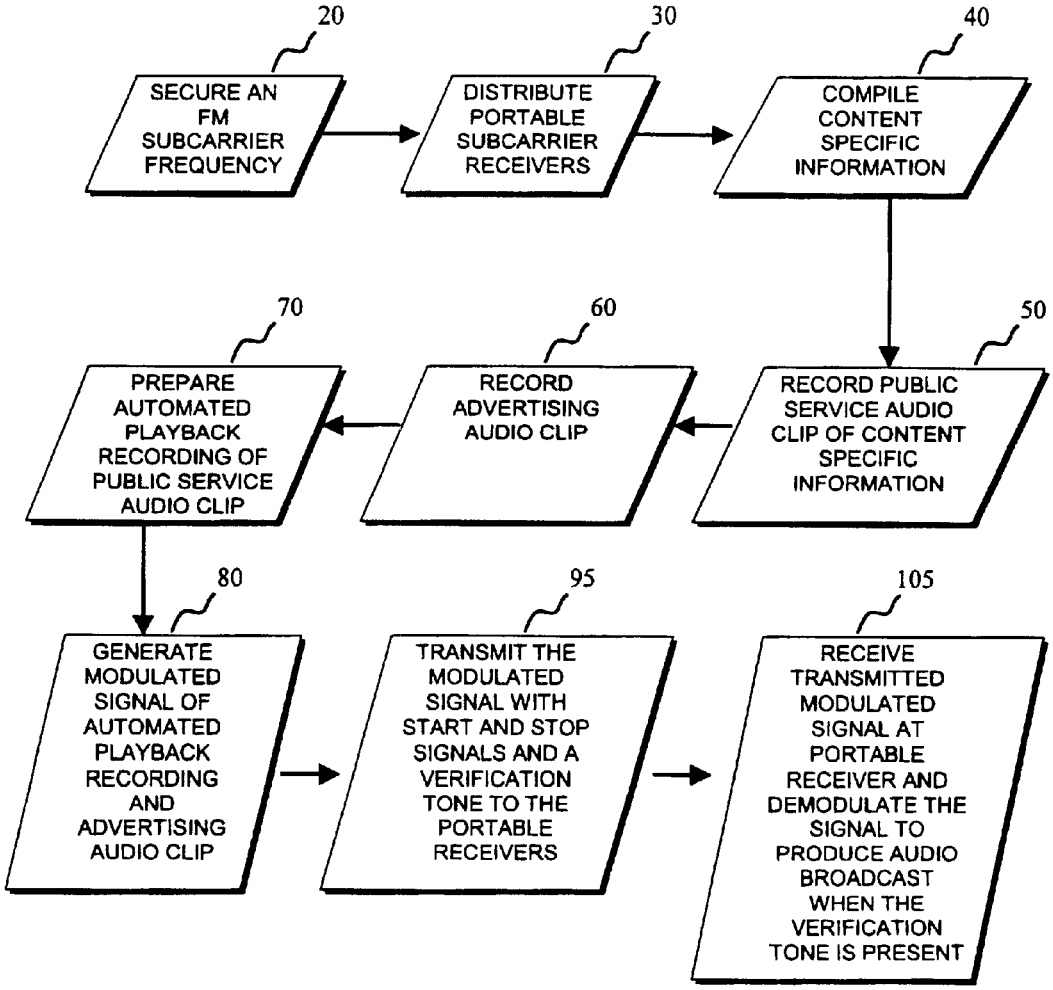
FIG. 3 is a flow diagram of an additional embodiment of the present invention.
Figure 4:
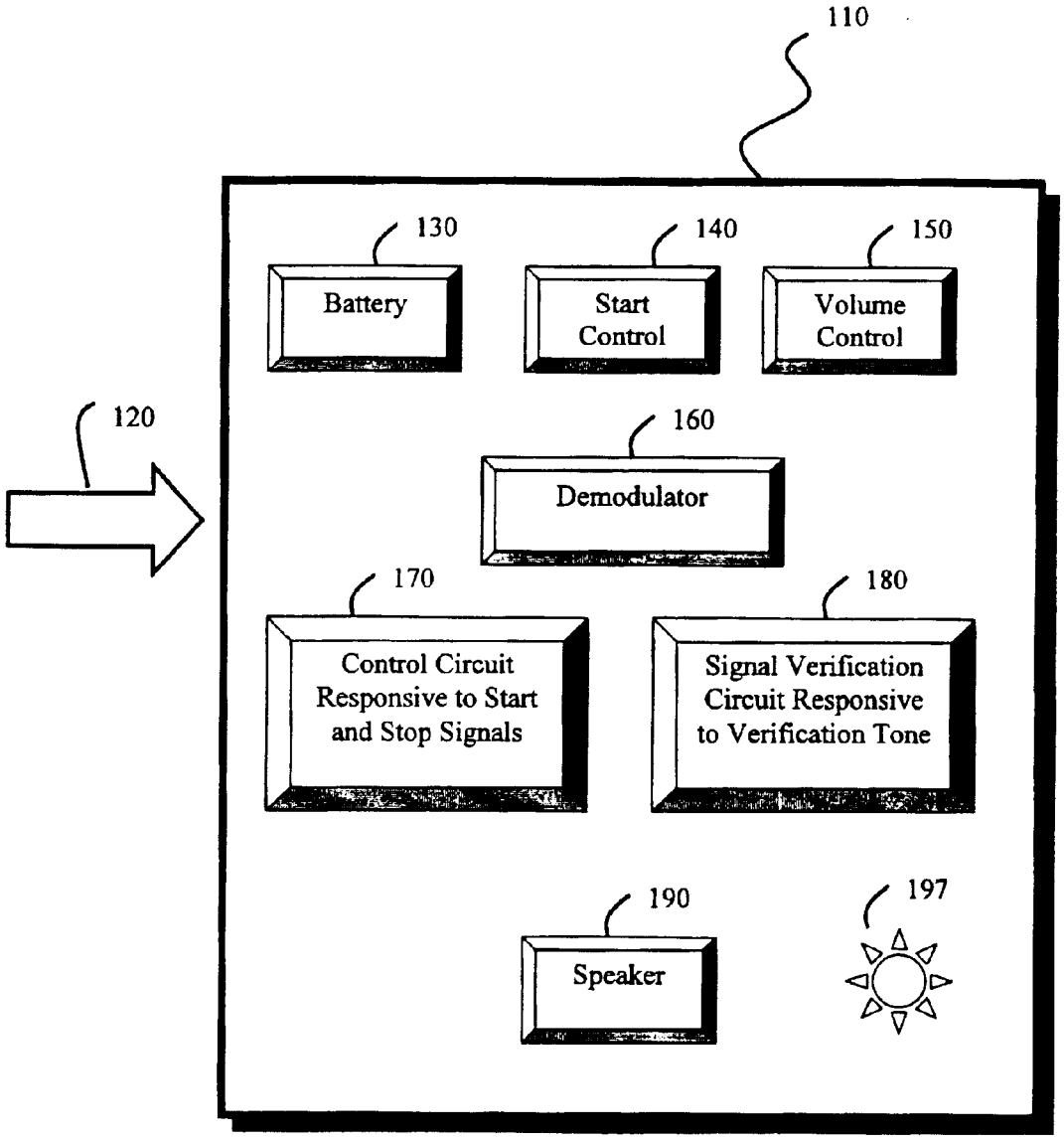
FIG. 4 is a block diagram of an additional embodiment of the portable receiver.

Broadcasting over FM subcarrier frequencies is known in the art. FM subcarrier broadcasts are often limited to subscribers paying to hear the broadcast. Pirating of these broadcasts is possible through modification of existing FM subcarrier receivers. It is an objective of this invention to prevent the FM subcarrier receiver of this invention from being modified and used to receive proprietary broadcasts. FIG. 3 illustrates a method and FIG. 4 illustrates an apparatus to meet this objective. The method is similar to that described previously in FIG. 1, with an additional inaudible verification tone being transmitted along with the automated playback recording and advertising audio clip 95. In FIG. 4, signal verification circuit 180 is included. When the transmission is received at portable receiver 105, signal verification circuit 180 monitors the receipt of the verification tone. If the verification tone is not present, the speaker is rendered inaudible. The verification tone can also be used to illuminate verification indicator 197 when the verification tone is received.

Figure 5:
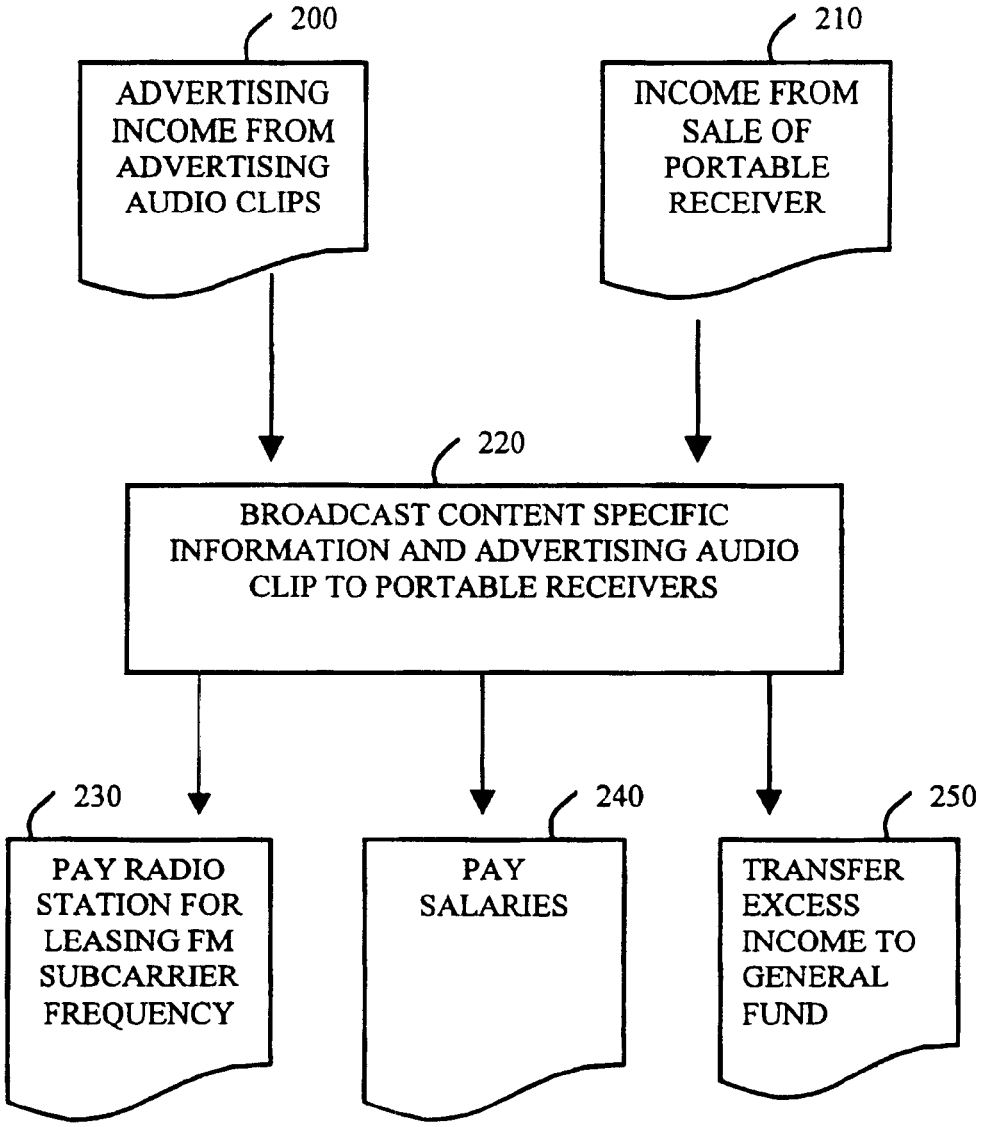
FIG. 5 is a flow diagram of the income and revenue associated with the Revenue Generating Method.

It is an objective of the present invention is to provide a method by which revenue is generated through the sale of FM subcarrier receivers and sponsor advertising. The generated revenue will create a viable business opportunity and supplement the expansion of the instant reporting system into additional markets. FIG. 5 illustrates the income and revenue flow associated with the present invention. Income is generated from contracting with sponsors to provide advertising audio clips 200. Income is also generated through the sale of portable receivers 210. The content specific information and the advertising audio clip are then broadcast to the receivers to fulfill the contract with sponsors 220. The radio station is paid for use of the FM subcarrier frequency 230. Salaries are paid to employees 240 and the excess income is invested into business 250.

Figure 6:
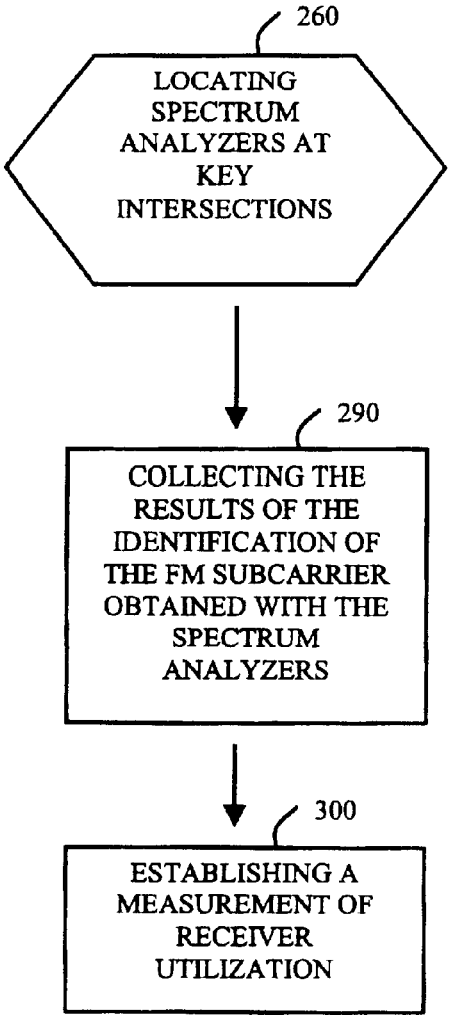
FIG. 6 is a flow diagram of a method of measuring receiver utilization.

It is another objective of the present invention to provide sponsors with results of the effectiveness of their marketing expenditures. One method to provide these results is illustrated in FIG. 6. Spectrum analyzers are located at key intersections 260. These key intersections may be areas where traffic congestion is likely to occur, at the entrance to a tunnel, at the beginning of a bridge, or any of a variety of other strategic locations. The spectrum analyzers detect the FM subcarrier frequency when the portable receivers are in use 290. The detected results are collected and used to establish a measurement of receiver utilization 300. This information can be used by the sponsors to evaluate the effectiveness of their marketing expenditures.

Figure 7:
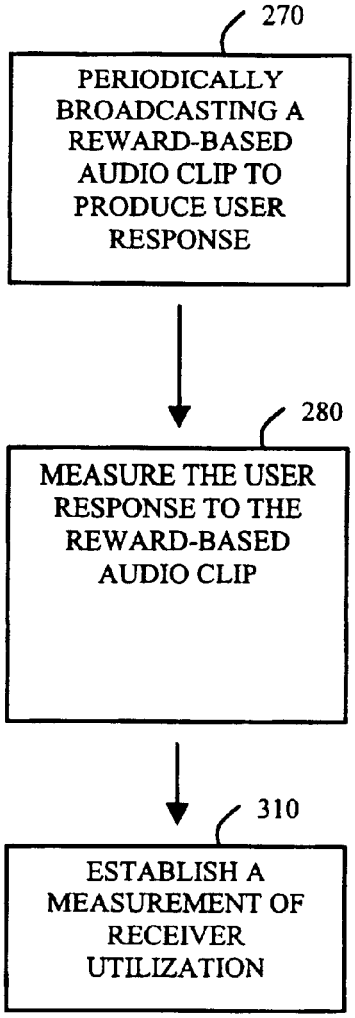
FIG. 7 is a flow diagram of an alternate method of measuring receiver utilization.

An alternative embodiment used to measure receiver utilization is illustrated in FIG. 7. A reward-based audio clip is broadcast periodically to produce user response 270. This reward-based audio clip is a "call to action" for the listener. The call to action may be related to a cash prize, promotional items, or a variety of other incentive possibilities. The user response is measured in response to reward-based audio clip 280 and a measurement of receiver utilization is established 310. Measurement 310 provides quantitative verification to sponsors 220 of the size of the listening audience.

Figure 8:
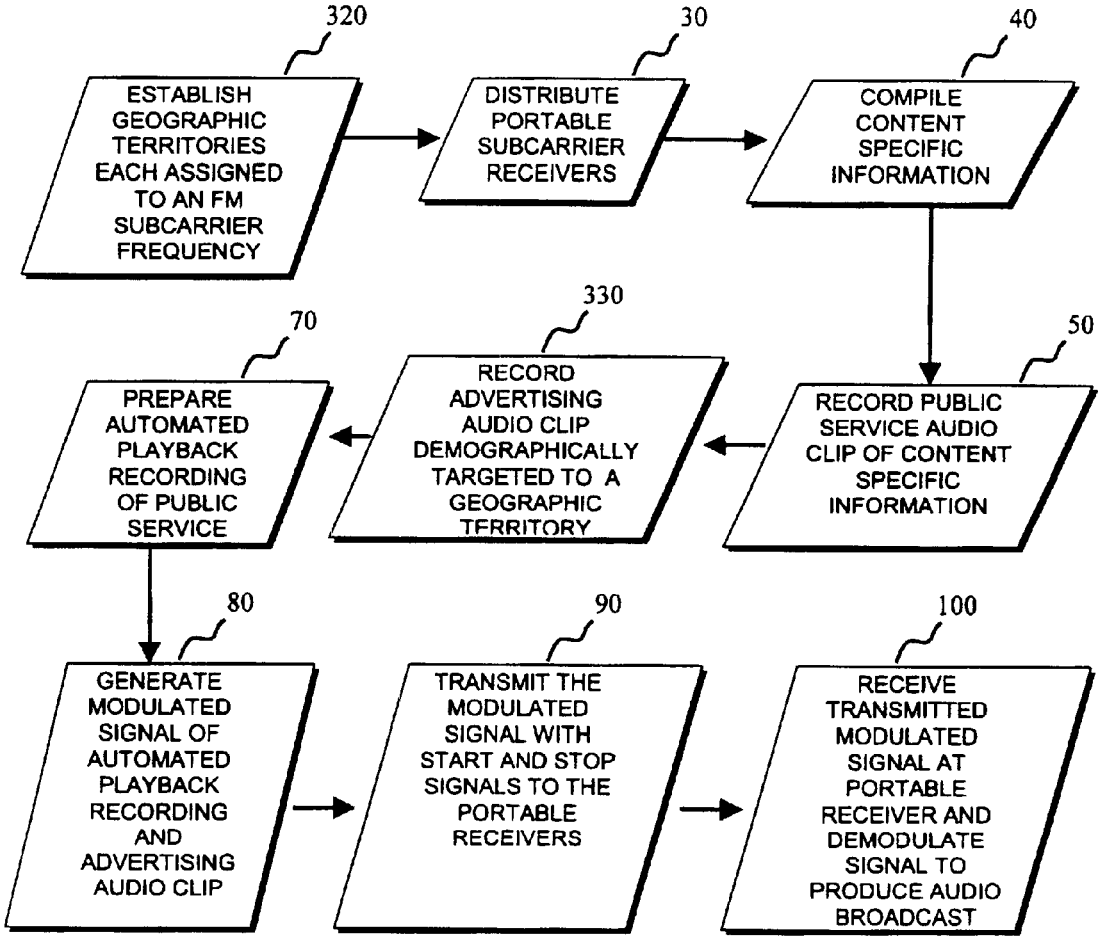
FIG. 8 is a flow diagram of an additional embodiment of the present invention utilizing target marketing.
Figure 9:
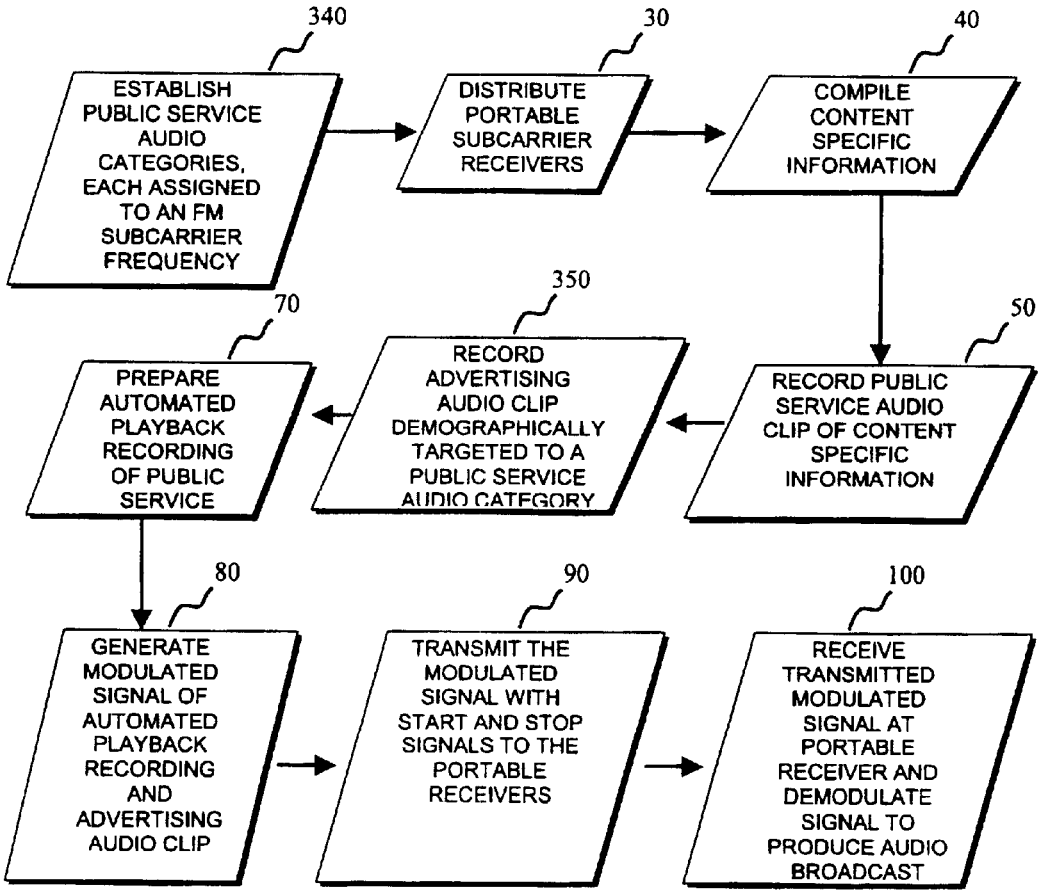
FIG. 9 is a flow diagram of an alternate method of target marketing.

The present invention also provides an opportunity for targeted marketing. FIG. 8 and FIG. 9 illustrate two method by which targeted marketing can be incorporated. The methods in FIG. 8 and FIG. 9 are similar to the method illustrated by FIG. 1. However, in FIG. 8, geographic territories are established and an FM subcarrier frequency is secured for each of geographic territories 320. The portable receivers are adapted to receive the specific geographic territory frequency. An advertising audio clip is demographically targeted to the specific geographic territory and broadcast over associated frequency 330. With this method, specific portable receivers can be targeted to receive advertising clips based on their geographic location. Similarly, in FIG. 9, public service audio categories are established and an FM subcarrier frequency is secured for each of audio categories 340. An advertising audio clip is demographically targeted to the specific public service audio categories and broadcast over associated frequency 350 for receipt by portable receiver adapted to receive the frequency.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall therebetween. Now that the invention has been described

What is claimed is:

1. A method of providing content specific information over an FM subcarrier frequency on demand, the method comprising:

securing at least one FM subcarrier frequency;

distributing portable receivers adapted to play audio signals broadcast on the at least one FM subcarrier frequency on demand;

compiling content specific information;

recording at least one public service audio clip including the content specific information;

recording at least one advertising audio clip;

preparing automated playback recording of the at least one public service audio clip;

generating a modulated signal of the automated playback recording of the at least one public service audio clip and the at least one advertising audio clip in coincident relation wherein users of the portable receivers desiring to hear the automated playback recording are also exposed to the at least one advertising audio clip;

transmitting the modulated signal and start and stop signals to the portable receivers in a continuous loop wherein the start signal indicates the beginning of the continuous loop and the stop signal identifies the end of the continuous loop; and receiving the transmission signal at the portable receiver wherein the portable receiver is adapted to demodulate the transmission signal providing an audio signal broadcast of duration specified by the start and stop signals.

2. The method of claim 1, wherein securing the FM subcarrier comprises leasing a subcarrier frequency from an FM broadcasting station operating between about 88 Mhz and about 108 Mhz.

3. The method of claim 2, wherein the lessee compiles the content specific information.

4. The method of claim 1, wherein securing the FM subcarrier comprises contracting with an FM broadcasting station to compile the content specific information.

5. The method of claim 1, wherein the content specific information is traffic congestion information occurring within the broadcast range of the FM subcarrier.

6. The method of claim 1, wherein the content specific information is current stock report information.

7. The method of claim 1, wherein the content specific information is current sports score information.

8. The method of claim 1, wherein the content specific information is emergency public safety information.

9. The method of claim 1, wherein the public service audio clip is continuously updated with current content specific information.

10. The method of claim 1, wherein the portable receivers are purchased by the end user.

11. The method of claim 1, wherein the portable receivers are purchased by the sponsors and distributed to the end user.

12. The method of claim 1, further comprising the step of powering off the portable receiver responsive to the detection of the stop signal.

13. The method of claim 1 wherein the FM subcarrier receiver further comprises:

a speaker adapted to play audio;

a battery adapted to supply power to the receiver;

a start control activatable by the user and adapted to initiate power on and off signals to the battery;

a demodulator adapted to demodulate the transmitted signal whereby the demodulation begins upon receipt of the start signal and ends upon receipt of the stop signal;

a control circuit whereby responsive to the detection of the start signal, a single loop of the audio is played until the stop signal is detected; and a volume control adapted to adjust the speaker volume.

14. The method of claim 13 wherein the start control is mechanically activated.

15. The method of claim 13 wherein the start control is voice activated.

16. The method of claim 13 wherein the start control is activated by movement.

17. The method of wherein the start control is activated on a predetermined schedule.

18. The method of claim 1, further comprising means to measure the utilization of the FM subcarrier receivers.

19. The method of claim 18 whereby means to measure the utilization of the FM subcarrier receivers comprises:

providing at least one spectrum analyzer adapted to identify the FM subcarrier frequency broadcast when said receiver is demodulating the FM subcarrier signal;

locating said spectrum analyzers at key intersections;

collecting the results of the identification of the FM subcarrier frequency broadcast obtained with the spectrum analyzers; and establishing a measurement of the utilization of said receivers.

20. A method of providing content specific information over an FM subcarrier frequency on demand, the method comprising:

securing at least one FM subcarrier frequency;

distributing portable receivers adapted to play audio signals broadcast on the at least one FM subcarrier frequency on demand;

compiling content specific information;

recording at least one public service audio clip comprising said content specific information;

recording at least one advertising audio clip;

preparing automated playback recording of the at least one public service audio clip;

generating a modulated signal of the automated playback recording of the at least one public service audio clip and the at least one advertising audio clip in coincident relation wherein users of the portable receivers desiring to hear the automated playback recording are also exposed to the at least one advertising audio clip;

transmitting the modulated signal and start and stop signals to the portable receivers on a first FM subcarrier frequency in a continuous loop wherein the start signal indicates the beginning of the continuous loop and the stop signal identifies the end of the continuous loop;

transmitting an inaudible verification tone coincident with the transmission of the modulated signal to the portable receiver; and receiving the modulated signal transmission and the verification tone transmission at the portable receiver wherein the portable receiver is adapted to demodulate the modulated signal transmission providing an audio signal broadcast of duration specified by the start and stop signals when the verification tone is present.

21. The method of claim 20, wherein securing the FM subcarrier comprises leasing a subcarrier frequency from an FM broadcasting station operating between about 88 Mhz and about 108 Mhz.

22. The method of claim 20, wherein the lessee compiles the content specific information.

23. The method of claim 20, wherein securing the FM subcarrier comprises contracting with an FM broadcasting station to compile the content specific information.

24. The method of claim 20, wherein the content specific information is current traffic information.

25. The method of claim 20, wherein the content specific information is current stock report information.

26. The method of claim 20, wherein the content specific information is current sports score information.

27. The method of claim 20, wherein the content specific information is emergency public safety information.

28. The method of claim 20, wherein the public service audio clip is continuously updated with current content specific information.

29. The method of claim 20, wherein the portable receivers are purchased by the end user.

30. The method of claim 20, wherein the portable receivers are purchased by the sponsors and distributed to the end user.

31. The method of claim 20, further comprising the step of powering off the portable receiver responsive to the detection of the stop signal.

32. The method of claim 20, wherein the verification tone is transmitted at a frequency above 20 kHz.

33. The method of claim 20, wherein the verification tone is transmitted at a frequency below 20 Hz.

34. The method of claim 20, wherein the verification tone is transmitted at a second FM subcarrier frequency.

35. The method of claim 20, further comprising the step of illuminating a verification indicator when the verification tone is received.

36. The method of claim 20 wherein the FM subcarrier receiver further comprises:

a speaker adapted to play audio;

a battery adapted to supply power to the receiver;

a start control activatable by the user and adapted to initiate power on and off signals to the battery;

a demodulator adapted to demodulate the transmitted signal whereby the demodulatation begins upon receipt of the start signal and ends upon receipt of the stop signal;

a control circuit whereby responsive to the detection of the start signal, a single loop of the audio is played until the stop signal is detected.

37. a volume control adapted to adjust the speaker volume; and a signal verification circuit adapted to monitor the volume of said speaker, whereby the speaker is rendered essentially inaudible in the absence of said verification tone.

38. The method of claim 36 wherein the start control is mechanically activated.

39. The method of claim 36 wherein the start control is voice activated.

40. The method of claim 36 wherein the start control is activated by movement.

41. The method of claim 36 wherein the start control is activated on a predetermined schedule.

42. The method of claim 20, further comprising means to measure the utilization of the FM subcarrier receivers.

43. The method of claim 41 whereby means to measure the utilization of the FM subcarrier receivers comprises:

providing at least one spectrum analyzer adapted to identify the FM subcarrier frequency broadcast when said receiver is demodulating the FM subcarrier signal;

locating said spectrum analyzers at key intersections;

collecting the results of the identification of the FM subcarrier frequency broadcast obtained with the spectrum analyzers; and establishing a measurement of the utilization of said receivers.

44. A method of generating advertising revenue by radio broadcast comprising the steps of:

securing at least one FM subcarrier frequency;

distributing portable receivers adapted to play audio signals broadcast on the at least one FM subcarrier frequency on demand;

recording at least one public service audio clip;

recording at least one advertising audio clip;

broadcasting the at least one public service audio clip and the at least one advertising audio clip in coincident relation wherein users of the portable receivers desiring to hear the at least one public service audio clip are also exposed to the at least one advertising audio clip;

broadcasting the at least one public service audio clip and the at least one advertising audio clip in a continuous loop;

including a start signal detectable by the portable receivers at the beginning of the continuous loop;

including a stop signal detectable by the portable receivers at the end of the continuous loop;

providing a start control on the portable receivers activatable by a user; and establishing a control circuit in the portable receivers whereby responsive to the detection of the start signal, a single loop of the audio is played through the portable receivers until the stop signal is detected.

45. The method of claim 43 further comprising the step of powering off the portable receivers responsive to the detection of the stop signal.

46. The method of claim 43 wherein the start control is mechanically activated.

47. The method of claim 43 wherein the start control is voice activated.

48. The method of claim 43 wherein the start control is activated by movement.

49. The method of claim 43 wherein the start control is activated on a predetermined schedule.

50. The method of claim 43 wherein the start and stop signals are substantially inaudible.

51. The method of claim 43 further comprising the steps of:

establishing a plurality of geographic territories, each assigned to an individual FM subcarrier frequency; and demographically associating the at least one advertising audio clip to each territory.

52. The method of claim 43 further comprising the steps of:

establishing a plurality of public service audio categories, each assigned to an individual FM subcarrier frequency; and demographically associating the at least one advertising audio clip to each category.

53. The method of claim 43 further comprising the steps of:

periodically broadcasting a reward-based audio clip adapted to produce a measurable user response; and evaluating the total number of active users based on the measurable user response whereby advertisers utilizing the method are provided with empirical data regarding the exposure they are obtaining in addition to encouraging more frequent use by the user.

* * * * *